US005813919A

United States Patent [19]

Best et al.

[11] Patent Number: 5,813,919

[45] Date of Patent: Sep. 29, 1998

[54] DUAL SOLE GOLF CLUB HEAD

[75] Inventors: Christopher Best, Encinitas; Phil Rodgers, San Diego; Robert Hirsch, Oceanside, all of Calif.

[73] Assignee: Cobra Golf, Inc., Carlsbad, Calif.

[21] Appl. No.: 672,361

[22] Filed: Jun. 28, 1996

[51] Int. Cl.[6] ..... A63B 53/04

[52] U.S. Cl. ..... 473/290; 473/328; 473/349; 473/350

[58] Field of Search ..... 473/328, 327, 473/344, 349, 350, 287, 290, 291

[56] References Cited

U.S. PATENT DOCUMENTS 5,154,423 10/1992 Antonious ..... 473/328

5,524,880 6/1996 Kobayashi ..... 473/291

*Primary Examiner*—Sebastiano Passaniti
*Assistant Examiner*—Stephen L. Blau
*Attorney, Agent, or Firm*—Pennie & Edmonds LLP

[57] ABSTRACT

A golf club head for an iron has a dual sole comprising first and second discontinuous surfaces which intersect along a diagonal line between the leading edge of the head at the toe and an intermediate point on a trailing edge of the head. The soles progressively taper from the long irons to the short irons so that the intersection of the diagonal line with the trailing edge is progressively closer to the toe. The head construction reduces weight in the toe and ground contact in the toe area, and moves the center of resistance toward the heel of the club. This reduces head droop and the tendency of the toe to dig into the ground, and, minimizes opening of the face at impact.

20 Claims, 6 Drawing Sheets

DUAL SOLE GOLF CLUB HEAD

BACKGROUND OF THE INVENTION

This invention relates generally to golf club heads, and more particularly to golf club heads of the "iron" type.

Golfers are continually striving to hit a golf ball perfectly on a consistent basis to make shots which are straight, accurate, and powerful. Unfortunately, imperfections in the golfer's swings, principally, and to a lesser degree external factors, prevent this objective from being achieved. The accuracy and straightness of shots depends upon the angle between the face of the head and the ball at impact. The direction in which the ball travels is determined by the normal to the plain of the face of the golf club head. Straight shots require that the head be square to the ball. If the head opens, i.e., rotates clockwise when viewed by the golfer, the shot slices to the right. If the club face closes, the shot hooks to the left.

Irons are particularly susceptible to inaccurate shots. Because of the natural tendency of the club head to contact the ground, resistance between the ground and a club head makes it difficult to keep the club face square. Moreover, when a club is swung, the weight of the club head causes the club head to bend or droop in a plane transverse to the direction of the swing, causing lowering of the toe of the club head. This produces greater ground contact and resistance in the area of the toe of the head, and combined with misalignment of the club during the swing can cause the toe of the club to dig into the ground so that the face rotates and strikes the ball misaligned. When this occurs, the ball will go right or slice.

It is desirable to provide golf clubs which help to compensate for imperfections in a golfer's swing, and which minimize the resulting inaccuracies which such imperfections can cause. It is also desirable to provide golf clubs with enhanced feel and which create straighter and more powerful shots. It is to these ends that the present invention is directed.

SUMMARY OF THE INVENTION

The invention provides a new and improved golf club head which minimizes the tendency of the head to droop when the club is swung, which provides significantly enhanced feel, and which minimizes inaccuracies in shots due to imperfections in a golfer's swing. The invention addresses the factors which contribute to such problems. It accomplishes the above objectives by reducing the contact of the club head with the ground, thereby reducing the ground resistance on the head, and by shaping the club head to promote contact with the ground at the heelside of the center of gravity of the head, thereby promoting the club to stay square at impact. The invention provides a club head having a shape which tends to reduce droop, thereby reducing the tendency of the toe to dig into the ground and moving the center of resistance between the club sole and the ground toward the heel of the club. This promotes advantageously ground contact more toward the heel of the club.

In one aspect, the invention provides a golf club head having a dual sole formed of two distinct surfaces. A first surface of the sole extends from the heel of the club toward the toe. The second surface extends from the toe toward the heel and intersects the first surface at a diagonal line which extends from the leading edge of the toe to an intermediate point between the heel and the toe on the trailing edge of the sole. The first surface has a tangent which makes a first predetermined angle with the ground when the club head addresses a ball. The second surface has a tangent which makes a second angle with the ground which is substantially greater than the first predetermined angle when the club addresses the ball.

The invention also provides a set of correlated club heads having dual surface soles which are progressively tapered from the long irons to the short irons so that the diagonal line from the leading edge at the toe to the trailing edge intersects the trailing edge progressively closer to the toe.

DESCRIPTION OF THE PREFERRED EMBODIMENTS

The invention provides golf club heads with a dual surface sole configuration which is particularly applicable to golf clubs of the iron type, and will be described in that context. It will be appreciated, however, that the invention has greater utility in connection with other types of clubs.

Figure 1A:
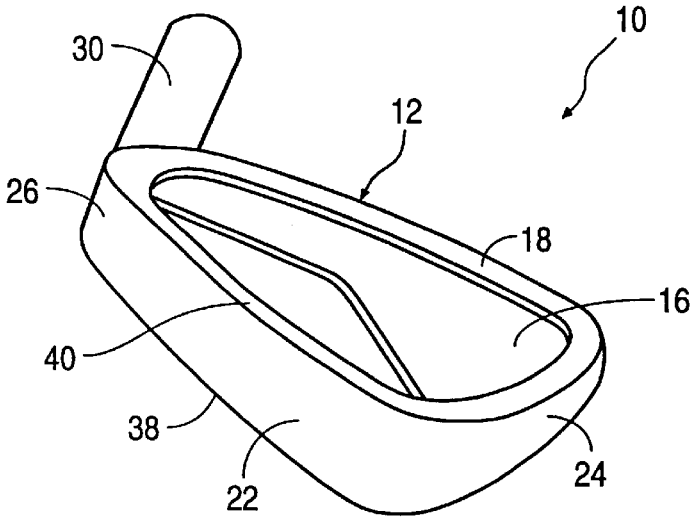
FIG. 1A PRIOR ART
FIGS. 1A–1C are, respectively, a bottom perspective view, a bottom elevation view, and a toe end perspective view of a conventional golf club head.
Figure 1B:
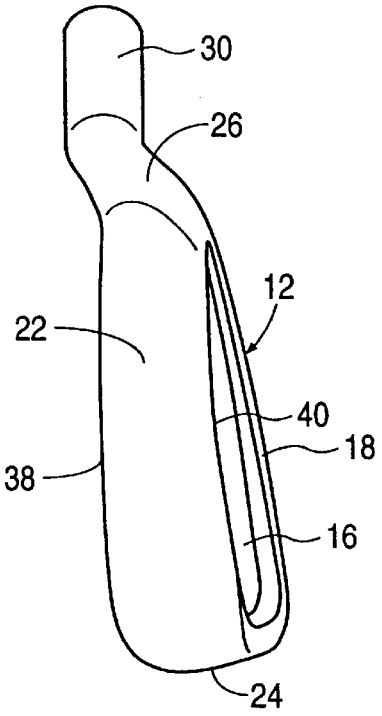
FIG. 1B PRIOR ART
Figure 1C:
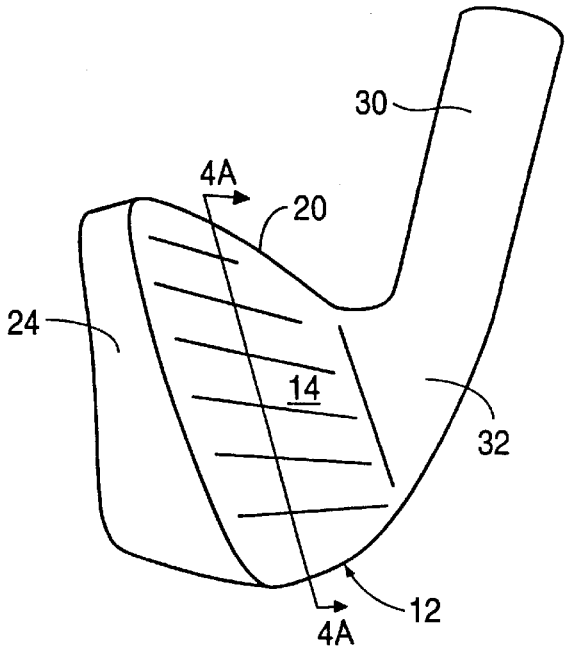
FIG. 1C PRIOR ART
Figure 2A:
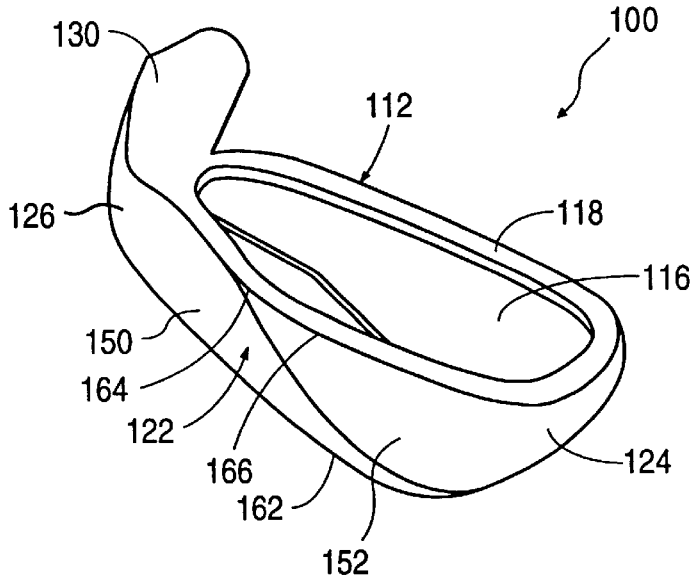
FIGS. 2A–2C are views similar to FIGS. 1A–1C, respectively, and are a bottom perspective view, a bottom elevation view, and a toe end perspective of a golf club head in accordance with the invention.
Figure 2B:
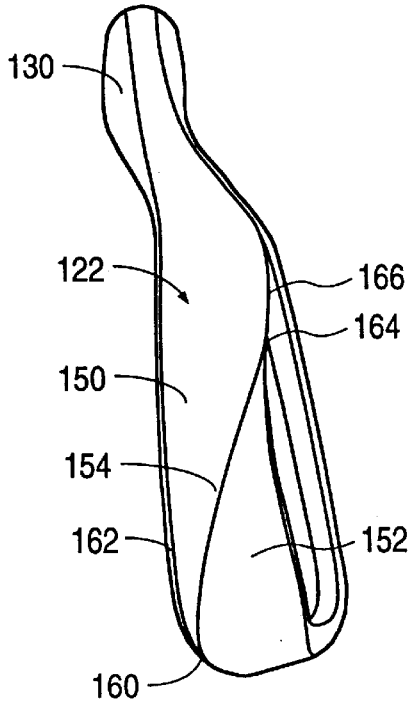
Figure 2C:
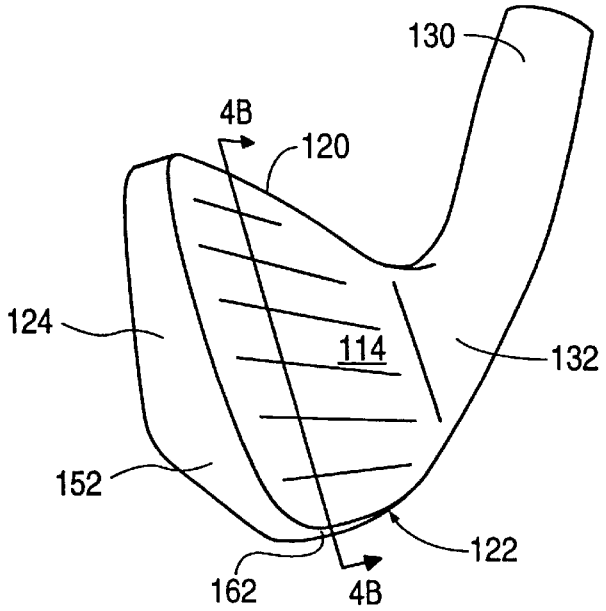
Figure 4A:
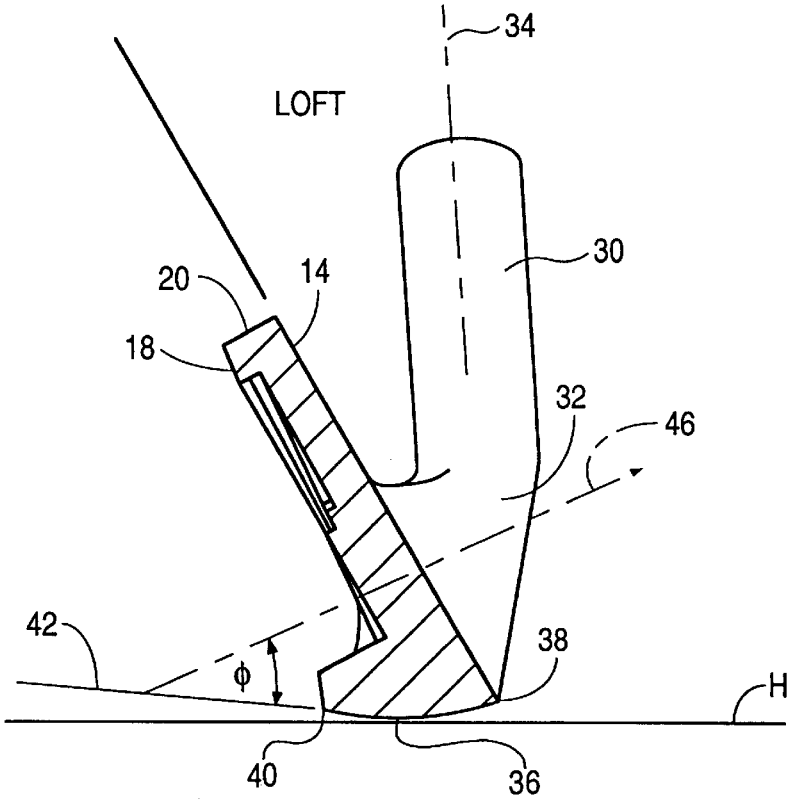
FIG. 4A PRIOR ART
FIGS. 4A–4B are cross-sectional views respectively taken along the lines 4A—4A of FIG. 1C which illustrate a conventional golf club head and taken along the lines 4B—4B of FIG. 2C which illustrate a golf club head in accordance with the invention.

FIGS. 1A–1C illustrate a conventional golf club head 10 for an iron type of golf club. As shown, the head comprises a solid metal body 12 having a front face 14, a back side 16 comprising a hollowed-out cavity area having a perimeter edge 18, a top surface 20 and a sole or bottom surface 22. As shown, the sole comprises a continuous surface which extends from a large end 24 of the head, which is referred to as the toe, to the opposite smaller end 26 of the head referred to as the heel. Extending upwardly from the heel of the head body is an integral hosel 30 comprising a tubular member adapted to receive the tip end of a golf club shaft (not shown). As shown in FIGS. 1B and 1C (and also in FIG. 4A), the axis 34 of the hosel does not lie in the plane of the front face 14 of the club head, but rather is offset at an angle and connected to the club body by a par area 32 comprising a smoothly-curved surface which transitions between the planar face 14 of the head and the hosel 30. As best shown in FIG. 4A, when the club addresses the ball, the axis 34 of the hosel (and the shaft) is substantially vertical. The angle between the axis 34 and the planar face 14 is referred to as the loft of the club. As the irons progress in number from the long irons to the short irons (increasing club number) the loft angle also increases, as is well known, so that a 9-iron has a loft angle that is substantially greater than a 1-iron or 2-iron, for example.

As best shown in FIG. 4A, when the golf club head addresses the ball and the axis of the shaft 34 is vertical, the sole 22 of the head contacts the ground at approximately a mid-point 36 of the surface 22 of the sole between the leading edge 38 and the trailing edge 40, and the shape of the sole is such that the leading edge 38 is raised slightly off the ground. The angle between a tangent line 42 to the curved surface 22 of the sole at approximately its mid-point of curvature 36 and the horizontal (H) is relatively small, e.g., 10°, as shown. Therefore, the angle ϕ between a projected normal 46 to the face of the club and the tangent 42 approximately corresponds to the loft angle of the club.

FIGS. 2A-C, 3 and 4B illustrate an improved golf club head 100 in accordance with the invention. As shown, the head comprises a body 112 comprising a front face 114, a cavity back 116 having a peripheral edge 118, a top surface 120, a toe 124, a heel 126, and a hosel 130 which is integral with body 112 and connected with the body by a smoothly curved par area 132. The overall shape of the golf club head 100 in accordance with the invention may be generally similar to the shape of the conventional golf club head 10. The shapes differ most notably by the dual surface sole 122 of the head 100 of the invention.

Figure 4B:
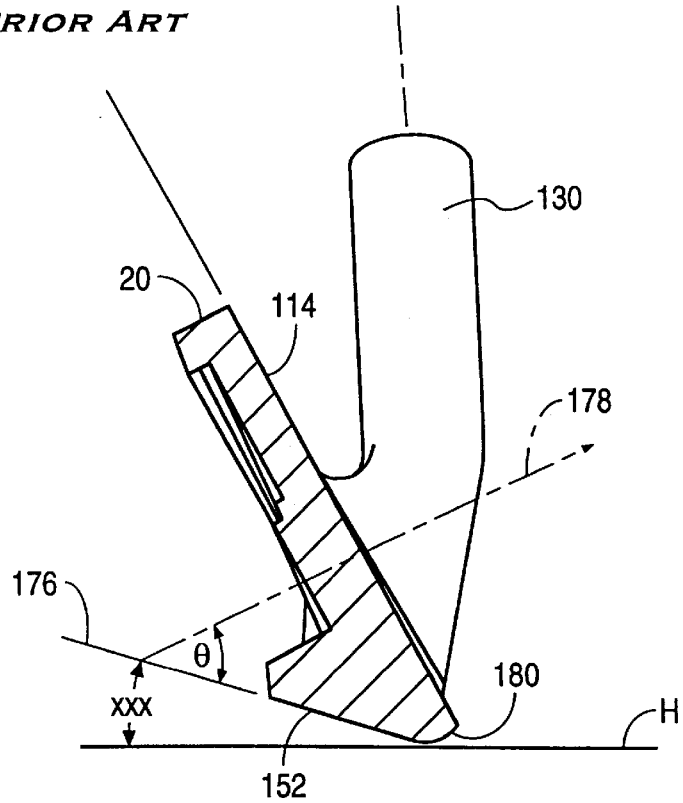

As best shown at FIGS. 2 A–B and 3, unlike the sole 22 of the conventional golf club head which comprises a substantially single curved surface which smoothly connects the toe 24 and heel 26 of the head and forms the continuous bottom surface of the head, the sole 122 of the head 100 in accordance with the invention is a dual, compound surface comprising two non-tangent surfaces 150 and 152 which intersect along a generally diagonal line 154 which extends from a point 160 at the toe of the lower leading edge 162 of the front face 114 to an intermediate point 164 of the lower trailing edge 166 at the back of the club head. The heelside surface 150 of the sole (adjacent to the heel) of head 100 may have a shape and make an angle with the ground substantially similar to that shown in FIG. 4A for the conventional head 10. However, the toeside surface 152 of the sole is cut back substantially relative to surface 150 as shown in FIG. 4B, so that a tangent 176 to surface 152 at approximately its midpoint of curvature makes a substantially larger angle relative to the horizontal (H) as best shown in FIG. 4B. Thus, as is also shown, the angle θ between tangent 176 and a normal 178 to the face 114 of the club is substantially greater than the corresponding angle ϕ of the conventional head shown in FIG. 4A. The invention enables the lower front leading edge 180 of the front face to be located higher from the ground (H), thereby reducing the tendency of the leading edge to contact the ground and dig in. Moreover, the shape of surface 152 and, in particular, the greater angle with the ground, results in less area of the cut-back sole surface 152 contacting the ground. This, in turn, produces less ground resistance to the sole of the head in the toe area, thereby further reducing the tendency of the face to open. Because of the cut-back shape of the dual sole, the head promotes contact with the ground at the heelside of the center of gravity of the head rather than at the toeside. This assists the club to remain square or slightly closed at impact, and produces a better hit, either straight or at a slight draw.

The cut-back of the sole surface 152 in the toe area afforded by the invention over that of a conventional head not only reduces ground resistance, it has another advantage. It enables the weight of the head in the toe area 124 of the head to be reduced, and the weight to be redistributed to the heel 126 while maintaining a desired total overall weight of 258 grams. Because the toe is lighter, droop or lowering of the toe of the club head during club swing is reduced. This also further reduces the tendency of the leading edge to contact the ground and dig in, and also results in the center of resistance between the head and the ground moving toward the heel. As described above, this makes the club head easier to control so that it remains square, and reduces the tendency of the face to open.

Figure 6:
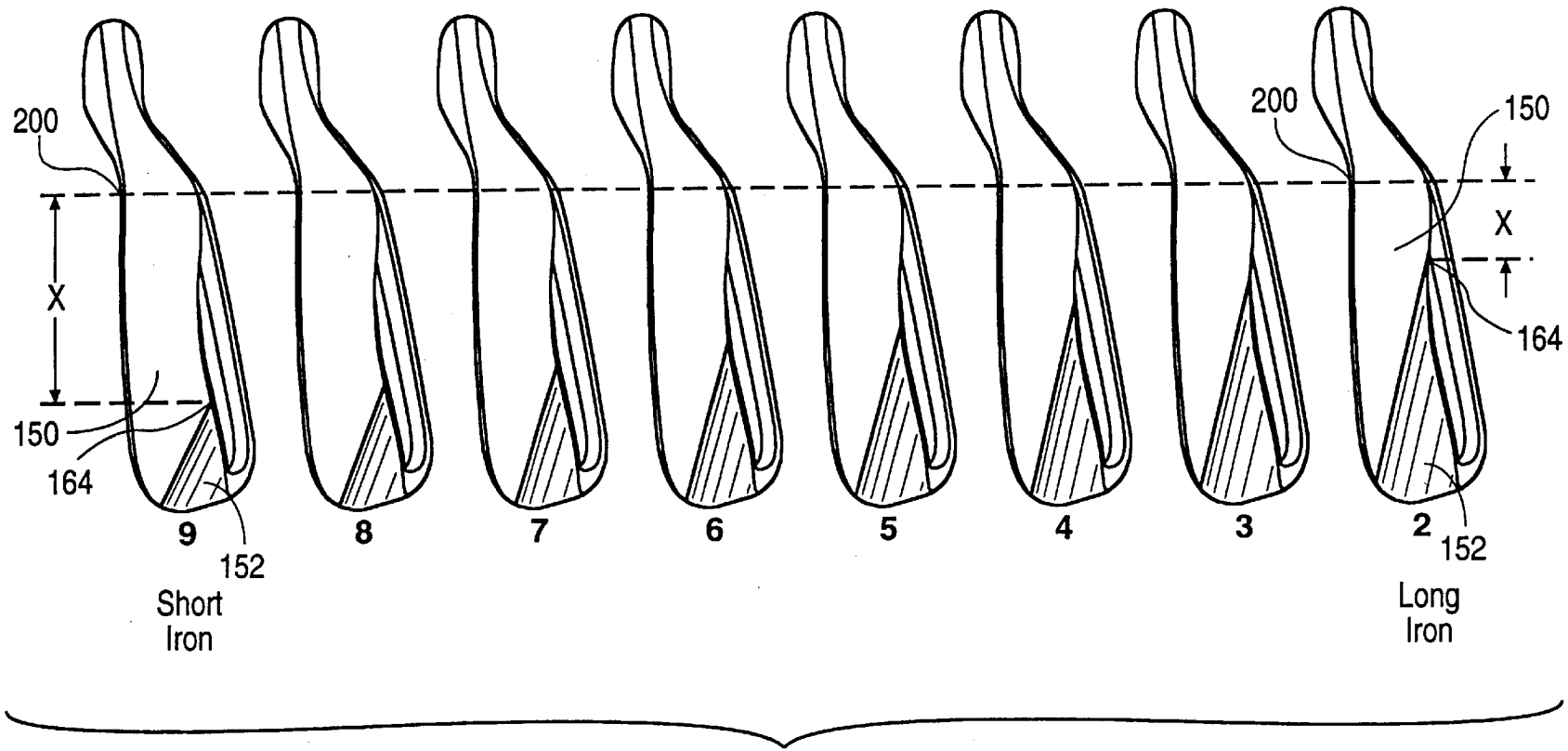
FIG. 6 illustrates the progressive taper from long irons to short irons of the dual surface soles of a set of correlated golf club heads in accordance with the invention.

Preferably, the area of surface 152 of the cut-back surface of the sole relative to the area of surface 150 decreases progressively from the long irons to the short irons. This is best illustrated in FIG. 6, which shows that for the long irons, i.e., a 2-iron or 3-iron, the surface area 152 of the cut back portion of the sole is greater than the surface area 152 of the cut back portion of the sole of the short irons, such as an 8-iron or a 9-iron. The reason for this is that the shaft of the long irons is longer than the shaft of the short irons. The longer shafts tend to bend more than the shorter shafts and produce more head droop, causing more tendency of the head to dig into the ground. Moreover, the longer the shaft, the more difficult the club is to control, and the larger cut-back portion of the sole compensates for the increased likelihood of digging in due to lack of control over the head.

Figure 3:
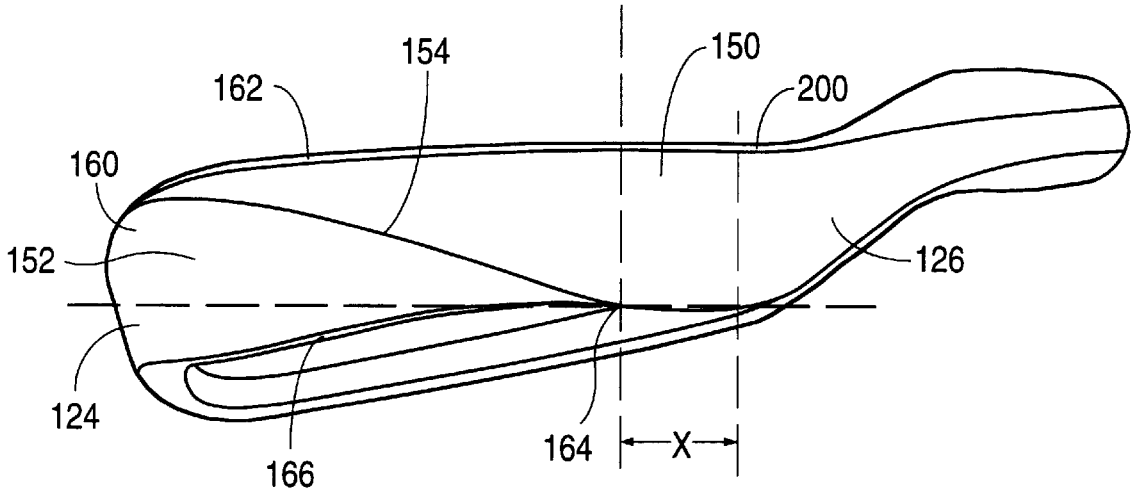
FIG. 3 is a bottom view illustrating in more detail the sole of a golf club head in accordance with the invention.

The following Table 1 and FIG. 6 show, by iron, for a preferred embodiment of the invention, the relative distance, X, of the sole point 164 from the origin 200 (see FIGS. 3 and 5A) of head 100. As noted earlier, the sole point 164 is the intersection between the lower rear trailing edge 166 of the sole and the diagonal line 154 representing the intersection of the two sole surfaces 150 and 152. The origin 200 of the head is defined as the point of intersection between the lower front leading edge 162 of the club sole and the furthest most heelside line 202 (see FIG. 5A) which lies within the plane of the club face 114 and divides the club face 114 from the smooth curved par area 132. This location corresponds to the beginning of the par area 132, which, as described previously, is the curved transition surface between the plane of the front face 114 and the hosel 130. The distance X in Table 1, as shown in FIGS. 3, is the longitudinal distance along the axis of the head between the origin 200 and the sole point 164. This distance progressively increases as the iron number increases, as shown in Table 1 and FIG. 6.

TABLE 1

| Iron | X Distance (Approx.) |
|---|---|
| 1 | .75 |
| 2 | .85 |
| 3 | .95 |
| 4 | 1.05 |
| 5 | 1.15 |
| 6 | 1.25 |
| 7 | 1.35 |
| 8 | 1.45 |
| 9 | 1.55 |

The following Table 2 shows, for the various clubs, the relationship between club loft, the angle θ corresponding to the angle between a normal to the face and the tangent to the surface 152 of the sole, and an angle XXX measured between tangent 176 and the horizontal H.

TABLE 2

| Club | Loft | θ | XXX° | (d) Location from Origin |
|---|---|---|---|---|
| 1 | 17° | 45° | 28° | 2.5" |
| 3 | 20° | 49° | 29° | 2.5" |

TABLE 2-continued

| Club | Loft | θ | XXX° | (d) Location from Origin |
|---|---|---|---|---|
| 4 | 23° | 51° | 28° | 2.5" |
| 5 | 26° | 53° | 27° | 2.5" |
| 6 | 29° | 55° | 26° | 2.5" |
| 7 | 32° | 57° | 25° | 2.5" |
| 8 | 35° | 59° | 24° | 2.5" |
| 9 | 39° | 61° | 22° | 2.5" |
| P | 43° | 61° | 18° | 2.5" |

As shown in Table 2, as the loft angle increases with increasing club number, the angle θ increases correspondingly. However, the angle XXX between the tangent 176 and surface 152 measured at a location (d) of 2.5 inches from the origin varies over a much smaller range of approximately 10° between about 28° for a 1-iron and 18° for a pitching wedge (P). Thus, the relative angular difference between sole surface 150 and surface 152 will be approximately equal to angle XXX shown in Table 2. This represents, in degrees, the amount of cut-back of sole surface 152 relative to sole surface 150 at a point 2.5 inches from the origin. The distance of 2.5 inches was selected to insure that the measurement on all clubs was taken at the same relative point located on the cut-back surface 152. Moreover, for the embodiment illustrated in Table 2, the angles XXX° for the 1-iron to 9-iron are in a small range, being in a range of about 7°, with the pitching wedge being about 11°. These are representative angles for this embodiment, and the invention contemplates angles within approximately ±2° of those shown in the Table, e.g., from about 16° to about 30°.

Figure 5A:
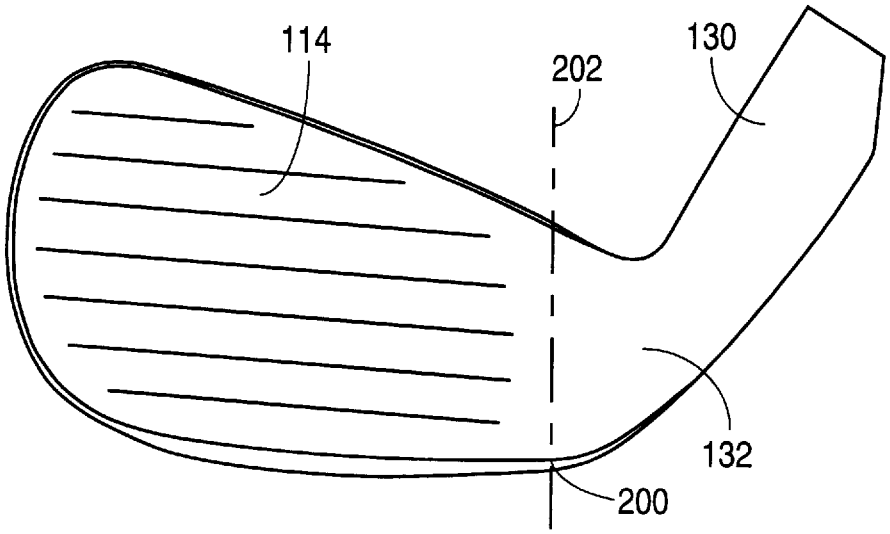
FIGS. 5A–5B are, respectively, a front elevation view and a top view of a golf club head in accordance with the invention.
Figure 5B:
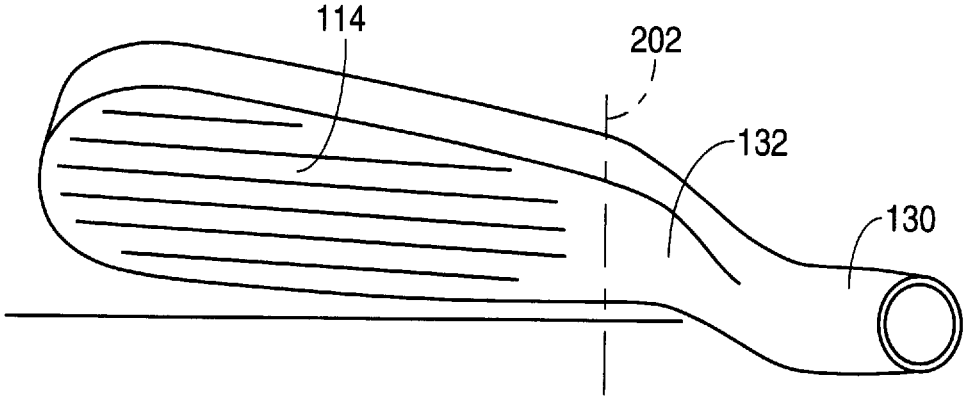

As shown in FIGS. 5A and 5B, a golf club head in accordance with the invention has a conventional appearance and shape when viewed from the front and from the top. Its playing characteristics, however, are substantially different from those of a conventional club. Because of the repositioning of the center of gravity of the head more toward the shaft of the club, golf clubs utilizing dual sole heads in accordance with the invention have a significantly enhanced feel to the golfer. Because the center of gravity of the head is closer to the heel, there is less bending and twisting movement on the shaft. This assists the golfer in maintaining better control of the club head, and reduces the tendency of the head to unsquare and misalign. Further, the reduction in head droop and ground resistance, and well as the movement of the center of resistance with the ground more toward the heel, similarly reduces the tendency of the toe to dig in and the club face to open. The overall result of the dual sole head construction of the invention is a club which is more balanced and which affords shots which are straighter, more accurate and more powerful.

While the foregoing has been with reference to a preferred embodiment of the invention, it will be appreciated by those skilled in the art that changes in this embodiment may be made without departing from the principles and spirit of the invention, the scope of which is defined in the appended claims.

What is claimed is:

1. A golf club head comprising a head body having a front face, a back side, a heel, a toe, a top, and a sole on a bottom of the head body which contacts the ground when the head addresses a ball; and a hosel in the area of the heel of the club body for receiving a shaft, the sole comprising discontinuous surfaces, including a first surface which extends from the end of the heel toward the toe and a second surface which extends from the toe toward the heel and intersects the first surface along a diagonal line which extends from a leading edge of the toe to an intermediate point between the heel and the toe on a trailing edge of the sole, the first surface having a tangent thereto which makes a first predetermined angle with the ground, and the second surface having a second tangent which makes a second angle with the ground which is greater than the first predetermined angle.

2. The golf club head of claim 1, wherein the difference between said first predetermined angle and said second angle is greater than approximately 16°.

3. The golf club head of claim 2, wherein said difference in angles is between approximately 18° and 30°.

4. A golf club head comprising a head body having a sole which contacts the ground when the head addresses a ball, the sole having a first surface extending from the end of a heel of the head body and a second surface extending from a toe of the head body toward the heel and intersecting said first surface along a diagonal between a leading edge of the sole in the region of the toe and an intermediate point on a trailing edge of the sole between the toe and the heel wherein said second surface of the sole comprises a cut-back portion of the sole wich makes a greater angle to the ground then an angle made by the first surface of the sole.

5. The golf club head of claim 4, wherein said first surface contacts the ground when the head addresses a ball, and said second surface is angled upwardly and away from the ground.

6. The golf club head of claim 5, wherein a tangent to said second surface at a point intermediate said leading edge and said trailing edge makes an angle with the ground of between 18° and 30°.

7. The golf club head of claim 4, wherein said intermediate point is located at a distance from the heel of between about one-fifth to four-fifths of a length of the head from the heel to the toe.

8. The golf club head of claim 4, wherein an angle between a tangent to said second surface and a projected normal line to a face of a golf club head is between about 45° and 60°.

9. A set of correlated golf club heads, each head having a heel, a toe, and a dual surface sole extending between the heel and the toe and comprising a first surface adjacent to the heel and a second surface adjacent to the toe, the first and second surfaces intersecting at a diagonal from a leading edge of the club head to a trailing edge of the club head, the dual surface soles of the set being progressively tapered so that the diagonal from the leading edge intersects the trailing edge progressively closer to the toe across the set of correlated heads; and wherein said first surface contacts the ground when a head addresses a ball and a tangent to said surface makes a first predetermined angle with the ground, and said second surface makes a second angle with the ground which is greater than the first predetermined angle.

10. The set of correlated golf club heads of claim 9, wherein said set comprises a set of irons including long irons and short irons, and wherein said dual surface soles are progressively tapered from the long irons to the short irons so that said diagonal line intersects the trailing edge progressively closer to the toe for the short irons.

11. The set of golf club heads of claim 10, wherein a tangent to the second surface makes an angle with the ground of greater than 16° for short irons and less than 30° for long irons.

12. The set of golf club heads of claim 11, wherein a projected normal to a face of the golf club head makes an angle with said tangents of approximately 60° for a short iron and approximately 45° for a long iron.

13. The set of golf club heads according to claim 9, wherein said heads comprise irons including long irons and short irons, and wherein said dual surface soles are progressively tapered from the long irons to the short irons.

14. The set of correlated golf club heads of claim 13, wherein said diagonal line intersects said trailing edge at a location of the order of approximately one-fifth the distance along the sole from the heel and located between the heel and the toe for a long iron of the set, and intersects the trailing edge at approximately four-fifths of the distance between the heel and the toe for a short iron.

15. A golf club head that has a heel, a toe and a sole, the sole extends from the heel to the toe and from a leading edge to a trailing edge, the sole is adapted to be adjacent to the ground at address, said sole comprising:

a first surface extending from the end of the heel toward the toe;

a second surface extending from the toe toward the heel and intersecting said first surface; and the first surface having a tangential line forming a predetermined first angle with the ground, and the second surface having a tangential line forming a predetermined second angle with the ground, and wherein the second angle is greater than the first angle.

16. The golf club head of claim 15, wherein the first surface intersects the second surface along a diagonal line which extends from the leading edge to the trailing edge of the sole.

17. The golf club head of claim 15, wherein the predetermined first angle is approximately parallel with the ground.

18. A set of golf club heads, each head having a heel, a toe and a sole, the sole extends from the heel to the toe and from a leading edge to a trailing edge, the sole is adapted to be adjacent to the ground at address, said sole comprising:

a first surface extending from the end of the heel toward the toe;

a second surface extending from the toe toward the heel; and intersecting said first surface; and the first surface having a tangential line forming a predetermined first angle with the ground and the second surface having a tangential line forming a predetermined second angle with the ground wherein the second angle is progressively greater than the first angle throughout the set.

19. The set of golf club heads of claim 18, wherein the second angle is progressively greater than the first angle throughout the set from the short irons to the long irons.

20. The set of golf club heads of claim 18, wherein the predetermined first angle is approximately parallel with the ground.

* * * * *